US011130027B2

(12) United States Patent
Chao et al.

(10) Patent No.: US 11,130,027 B2
(45) Date of Patent: Sep. 28, 2021

(54) GOLF CLUB HEAD

(71) Applicant: Taylor Made Golf Company, Inc., Carlsbad, CA (US)

(72) Inventors: Bing-Ling Chao, San Diego, CA (US); Todd P. Beach, Encinitas, CA (US); John Francis Lorentzen, El Cajon, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 17/071,153

(22) Filed: Oct. 15, 2020

(65) Prior Publication Data

US 2021/0101056 A1 Apr. 8, 2021

Related U.S. Application Data

(63) Continuation of application No. 16/361,437, filed on Mar. 22, 2019, now Pat. No. 10,835,785, which is a (Continued)

(51) Int. Cl.

| | |
|---|---|
| ***A63B 53/04*** | (2015.01) |
| ***A63B 60/02*** | (2015.01) |
| *A63B 60/52* | (2015.01) |

(52) U.S. Cl.

CPC ..... *A63B 53/0466* (2013.01); *A63B 60/02* (2015.10); *A63B 53/042* (2020.08);

(Continued)

(58) Field of Classification Search

CPC . A63B 53/0466; A63B 60/02; A63B 53/0433; A63B 53/0437;

(Continued)

(56) References Cited

U.S. PATENT DOCUMENTS

| | | | |
|---|---|---|---|
| 1,133,129 | A | 3/1915 | Govan |
| 3,567,228 | A | 3/1971 | Lynn |

(Continued)

FOREIGN PATENT DOCUMENTS

| | | |
|---|---|---|
| GB | 2 338 903 | 1/2000 |
| JP | UH05-068564 | 9/1993 |

(Continued)

OTHER PUBLICATIONS

Japanese Office action for Japanese Patent Application No. 2014-044516 (and its English translation), dated Apr. 21, 2015, 12 pages.

(Continued)

*Primary Examiner* — Stephen L Blau

(74) *Attorney, Agent, or Firm* — Klarquist Sparkman, LLP

(57) ABSTRACT

A golf club head includes a head body having a crown, sole and skirt therebetween, the head body defining an opening in a front portion and having a frame support around the periphery of the opening. A face plate is mounted within the opening and has a transition radius along one or more edges to at least partially wrap around one or more of the crown, sole and skirt. The head includes thin wall zones in the crown and skirt, a hosel flush with the crown and a weight mounted in the sole proximate to the face plate, such that the golf club head has a center of gravity located relatively low and forward in proximity to the face plate.

20 Claims, 11 Drawing Sheets

Related U.S. Application Data continuation of application No. 15/666,295, filed on Aug. 1, 2017, now Pat. No. 10,265,589, which is a continuation of application No. 13/789,441, filed on Mar. 7, 2013, now Pat. No. 9,750,991.

(52) U.S. Cl.
CPC ..... *A63B 53/0433* (2020.08); *A63B 53/0437* (2020.08); *A63B 60/52* (2015.10); *A63B 2053/0491* (2013.01); *A63B 2209/02* (2013.01)

(58) Field of Classification Search
CPC ..... A63B 2053/0491; A63B 60/52; A63B 2209/02; A63B 60/00; A63B 53/0416; A63B 53/042; A63B 53/0425; A63B 53/0429
See application file for complete search history.

(56) References Cited

U.S. PATENT DOCUMENTS

| | | | |
|---|---|---|---|
| 3,695,618 | A | 10/1972 | Woolley et al. |
| 4,804,188 | A | 2/1989 | McKee et al. |
| 4,884,812 | A | 12/1989 | Nagasaki et al. |
| 5,106,094 | A | 4/1992 | Desbiolles et al. |
| 5,261,664 | A | 11/1993 | Anderson |
| 5,344,140 | A | 9/1994 | Anderson |
| 5,346,216 | A | 9/1994 | Aizawa |
| 5,425,535 | A | 6/1995 | Gee |
| 5,433,440 | A | 7/1995 | Lin |
| 5,480,153 | A | 1/1996 | Igarashi |
| 5,494,281 | A | 2/1996 | Chen |
| 5,505,453 | A | 4/1996 | MacK |
| 5,518,242 | A | 5/1996 | Mahaffey et al. |
| 5,720,673 | A | 2/1998 | Anderson |
| 5,774,970 | A | 7/1998 | Huang |
| 5,776,011 | A | 7/1998 | Su et al. |
| RE35,955 | E | 11/1998 | Lu |
| 5,830,084 | A | 11/1998 | Kosmatka |
| 5,851,160 | A | 12/1998 | Rugge et al. |
| 5,863,261 | A | 1/1999 | Eggiman |
| 5,906,550 | A | 5/1999 | Kingston |
| 5,916,038 | A | 6/1999 | Uchiyama et al. |
| 5,935,019 | A | 8/1999 | Yamamoto |
| 5,935,020 | A | 8/1999 | Stites |
| 5,993,329 | A | 11/1999 | Shieh |
| 5,993,331 | A | 11/1999 | Shieh |
| 6,010,411 | A | 1/2000 | Reyes |
| 6,050,904 | A | 4/2000 | Kuo |
| 6,146,287 | A | 11/2000 | Rugge et al. |
| 6,162,133 | A | 12/2000 | Peterson |
| 6,193,614 | B1 | 2/2001 | Sasamoto et al. |
| 6,248,025 | B1 | 6/2001 | Murphy et al. |
| 6,254,494 | B1 | 7/2001 | Hasebe et al. |
| 6,364,789 | B1 | 4/2002 | Kosmatka |
| 6,390,932 | B1 | 5/2002 | Kosmatka et al. |
| 6,440,011 | B1 | 8/2002 | Hocknell et al. |
| 6,582,323 | B2 | 6/2003 | Soracco et al. |
| 6,595,871 | B2 | 7/2003 | Sano |
| 6,607,451 | B2 | 8/2003 | Kosmatka et al. |
| 6,648,774 | B1 | 11/2003 | Lee |
| 6,669,576 | B1 | 12/2003 | Rice |
| 6,669,577 | B1 | 12/2003 | Hocknell |
| 6,773,360 | B2 | 8/2004 | Willett |
| 6,969,326 | B2 | 11/2005 | De Shiell |
| 7,004,852 | B2 | 2/2006 | Billings |
| 7,140,974 | B2 | 11/2006 | Chao et al. |
| 7,267,620 | B2 | 9/2007 | Chao et al. |
| 7,357,730 | B2 | 4/2008 | Shieh |
| 7,448,964 | B2 | 11/2008 | Schweigert et al. |
| 7,524,249 | B2 | 4/2009 | Breier |
| 7,559,854 | B2 | 7/2009 | Harvell et al. |
| 7,585,233 | B2 | 9/2009 | Horacek et al. |
| 7,628,712 | B2 | 12/2009 | Chao et al. |
| 7,682,264 | B2 | 3/2010 | Hsu et al. |
| 7,731,603 | B2 | 6/2010 | Beach |
| 7,771,291 | B1 | 8/2010 | Willett |
| 7,850,546 | B2 | 12/2010 | Chao et al. |
| 7,871,340 | B2 | 1/2011 | Chao |
| RE42,544 | E | 7/2011 | Chao et al. |
| 8,096,897 | B2 | 1/2012 | Beach et al. |
| 8,202,175 | B2 | 6/2012 | Ban |
| 8,221,261 | B2 | 7/2012 | Curtis et al. |
| 8,235,841 | B2 | 8/2012 | Stites et al. |
| 8,241,142 | B2 | 8/2012 | Evans |
| 8,430,763 | B2 | 4/2013 | Beach et al. |
| 8,444,504 | B2 | 5/2013 | Chao et al. |
| 8,540,590 | B2 | 9/2013 | Tsukada et al. |
| 8,636,610 | B2 | 1/2014 | Golden |
| 8,834,290 | B2 * | 9/2014 | Bezilla ..... A63B 53/0466 473/329 |
| 8,870,679 | B2 | 10/2014 | Oldknow |
| 8,876,629 | B2 | 11/2014 | Deshmukh |
| 9,750,991 | B2 | 9/2017 | Chao et al. |
| 2001/0055995 | A1 | 12/2001 | Cackett et al. |
| 2002/0065146 | A1 | 5/2002 | Kusumoto |
| 2003/0036442 | A1 | 2/2003 | Chao et al. |
| 2003/0139227 | A1 | 7/2003 | Sugimoto |
| 2005/0026718 | A1 | 2/2005 | Chen |
| 2005/0059508 | A1 | 3/2005 | Burnett et al. |
| 2007/0155539 | A1 | 7/2007 | Schweigert et al. |
| 2009/0239680 | A1 | 9/2009 | Horacek et al. |
| 2010/0151960 | A1 | 6/2010 | Wahl |
| 2011/0275451 | A1 | 11/2011 | Chao et al. |
| 2011/0294599 | A1 | 12/2011 | Albertsen |
| 2012/0142447 | A1 | 6/2012 | Boyd et al. |
| 2012/0196701 | A1 | 8/2012 | Stites |
| 2012/0289361 | A1 | 11/2012 | Beach |
| 2012/0289363 | A1 | 11/2012 | Myrhum et al. |
| 2013/0324308 | A1 | 12/2013 | Boyd et al. |
| 2014/0080624 | A1 | 3/2014 | Galvan et al. |
| 2014/0106903 | A1 | 4/2014 | Nakamura |
| 2014/0256464 | A1 | 9/2014 | Chao et al. |
| 2019/0282867 | A1 | 9/2019 | Chao et al. |

FOREIGN PATENT DOCUMENTS

| | | |
|---|---|---|
| JP | 09-299519 | 11/1997 |
| JP | 10-155943 | 6/1998 |
| JP | 2000-116823 | 4/2000 |
| JP | 2000-167089 | 6/2000 |
| JP | 2002-186691 | 7/2002 |
| JP | 2002-186692 | 7/2002 |
| JP | 2002-315854 | 10/2002 |
| JP | 2003-518993 | 6/2003 |
| JP | 2003-126309 | 11/2004 |
| JP | 2005-312942 | 11/2005 |
| JP | 2006-136455 | 6/2006 |
| JP | 2006-320493 | 11/2006 |
| JP | 2005-287952 | 10/2008 |
| JP | 2009-166 | 1/2009 |
| JP | 2009-148558 | 7/2009 |
| JP | 2012-501745 | 1/2012 |
| JP | 2010-142448 | 6/2012 |
| JP | 2012-50807 | 7/2012 |

OTHER PUBLICATIONS

"Cleveland HiBore Monster XLS Driver—Cleveland Golf Winter 2009 Products," downloaded from http://golf.about.com/od/equipmentreviews/ss/clevelandwin09_5.htm, 1 pp. (2009).
"Callaway Lady Fusion FT-iQ Driver (460 cc)—Ladies Drivers—Ladies," downloaded from http://golfio.com/index.php/ladies-equipment/drivers/callaway-lady-fusion-ft-iq-driver-460cc-88876.html, 2 pp. (document not dated, downloaded on Jun. 6, 2013).
Japanese Office action for Japanese Patent Application No. 2014-044516 (w/ an English translation) dated Mar. 22, 2016, 6 pages.
Office Action (with English translation) for related Japanese Application No. 2017-081876, dated Feb. 9, 2018, 10 pages.

* cited by examiner

GOLF CLUB HEAD

CROSS-REFERENCE TO RELATED APPLICATION

This application is a continuation of U.S. patent application Ser. No. 16/361,437, filed Mar. 22, 2019, which is a continuation of U.S. patent application Ser. No. 15/666,295, filed Aug. 1, 2017, now U.S. Pat. No. 10,265,589, which is a continuation of U.S. patent application Ser. No. 13/789,441, filed Mar. 7, 2013, now U.S. Pat. No. 9,750,991, all of which are incorporated by reference herein in their entirety.

BACKGROUND

The present disclosure relates generally to golf clubs and, more particularly, to a golf club head having an improved face plate support and performance enhancing center of gravity location.

Many factors must be considered when designing a golf club head. One factor is the distribution of mass about the club head, which is typically quantified by parameters such as moments of inertia (MOI) magnitude and center of gravity (CG) location. Rotational moments of inertia of a club head about the club head CG are measures of a club head's resistance to rotation about the CG and are related to the distribution of mass within the club head about the CG. Generally, it is desirable for a club head to have high moments of inertia about the CG, particularly to promote forgiveness for off-center hits. To achieve high moments of inertia about the CG, designers typically position mass to the periphery of the golf club head and backwards from the face plate. In addition, a club head's CG is spaced from the face plate at a prescribed location to achieve a desired launch angle upon impact with a golf ball. As a result, for wood-type club heads (i.e., fairway woods and drivers), large internal volumes are typically desirable.

In order to maximize the MOI about the CG and provide the face plate with a desirable high coefficient of restitution (COR), it typically is desirable to incorporate thin walls and a light face plate into the design of the club head. Thin walls afford designers additional leeway in distributing mass to more strategic locations within the club head. In addition, the use of a lighter composite face plate in place of a more traditional metal face plate creates additional mass savings that can be distributed advantageously elsewhere. Composite face plates however create design and manufacturing issues because they typically are much thicker than the metal club head, making it difficult to provide a smooth transition at the interface between the head's thin supporting wall and thicker composite face plate, especially in the crown area. In making this transition, the thin supporting wall typically undergoes a reverse angle due to the geometry at the interface, complicating the casting process when the club head body is manufactured.

Also, one significant drawback of the industry's conventional approach of trying to maximize MOI about the CG to promote forgiveness and greater ball speed during off-center ball strikes is that the ball tends to have undesirably high backspin as the ball leaves the club face (especially in the context of a driver). This means that the ball will balloon and lose distance.

It should therefore be appreciated that there exists a need for a golf club head having a composite face plate (or face insert) and other design features that facilitate better performance and durability, impart less backspin to the ball, provide a smooth transition between the main body and face plate, free up discretionary mass to be strategically distributed elsewhere, and improve the manufacturing process.

SUMMARY

In one embodiment, the present disclosure describes a golf club head comprising a body having a crown, a sole and skirt disposed between the crown and sole. It further includes a composite face plate having a crown end, sole end and skirt ends therebetween, the crown, sole and skirt defining an opening to receive the face plate. The club has a CGz/CGy ratio less than −0.2 and a club volume of at least 425 $cm^3$.

In other examples, the club head may have a club head volume of at least about 460 $cm^3$, a club head volume of about 425 to 470 $cm^3$, a maximum height of at least 50 mm, a height of about 50 mm to 60 mm, a loft angle less than about 15 degrees, a CGz/CGy ratio of about −0.2 to −0.41, a CGz/CGy ratio less than about −0.23, a CGz/CGy ratio less than −0.25, a CGz/CGy ratio less than −0.35 and/or a leading crown edge that is set back at least about 14 mm to 19 mm from a leading edge of the sole.

In another embodiment, the present disclosure describes a golf club head comprising a body having a crown, a sole and skirt disposed between the crown and sole. It further includes a composite face plate having a crown end, sole end and skirt ends therebetween, the crown, sole and skirt defining an opening to receive the face place. The channel may have a channel depth of about 8.8 mm to 4.1 mm, channel height of about 3.9 mm to 4.1 mm, and at least three separate substantially flat surfaces for engaging the face plate.

In another embodiment, a golf club head includes a body having a crown, a sole, a skirt disposed between the crown and sole, and a shaft-receiving hosel. The hosel has a bore defining a hosel axis. The club head also includes a composite face plate having an outer wall, the crown, sole and skirt defining an opening for mounting the face plate. The head also includes a weight plug mounted within a weight port located in the sole. The weight plug may have a length of about 40 mm to 60 mm, a width of about 14 mm to 18 mm, and a geometric center located about 14 to 20 mm from a leading edge of the sole.

In one aspect, the plug may have a mass of about 50 to 75 grams. The plug may have a rectangular shape and be made from a tungsten alloy. In other embodiments, the plug may have alternative geometric (e.g., round, triangular, square, trapezoidal, etc.) or irregular shapes. The club head may have any of the foregoing features, including a CGz/CGy ratio less than about −0.2 and a volume of at least 360 $cm^3$, as well as a hosel that terminates at one end in a substantially flush relationship with the crown.

In yet another aspect, the club head may have a plurality of thin wall zones formed in a portion of the crown and/or skirt which are separated by a web of thicker wall portions therebetween. In one aspect, the thin wall zones may have a thickness of about 0.4 mm and the web of thicker walls may have a thickness of about 0.6 mm.

In yet another example, a golf club head includes a body having a crown, a sole, a skirt therebetween and a hosel having a shaft receiving bore. It further includes a composite face plate that is supportively received within an opening defined by the crown, sole and skirt. The composite face plate can have an outer wall with a transition radius of curvature along one edge at an interface juncture with at least one of the sole, crown and skirt. At least one of the crown and skirt may have a plurality of thin wall zones defined by pockets in an inner surface of the crown and/or skirt. A weight port may be formed in the sole, and a weight plug mounted within the weight port, wherein the weight plug includes at least some redistributed mass saved by the transition radius of the face plate and thin wall zones. The club head may have any of the foregoing features including a CGz/CGy ratio less than about −0.2, a CGz/CGy ratio of about −0.2 to −0.41, volume of about 425 to 470 $cm^3$, weight plug mass of about 50 to 75 grams, and/or CGz of at least −6 mm.

In another aspect, the face plate has an outer wall with a surface area of 4200 to 5000 $mm^2$.

In still another aspect, a CGz value is defined as the distance the CG of the club head is located above or below a horizontal plane (i.e., a plane parallel to a ground plane) that passes through the center of the face of the club head, with positive CGz values representing a CG located above the horizontal plane, and negative CGz values representing a CG located below the horizontal plane. In several examples, the CGz of the club head is less than −6 mm, such as less than −8 mm, such as less than −10 mm.

In yet another aspect, a CGy value is defined as the distance the CG of the club head is located to the rear of a vertical plane (i.e., a plane perpendicular to a ground plane) that is tangent to the center of the face of the club head. In several examples, the CGy of the club head is no more than 29 mm, such as no more than 26 mm, such as no more than 24 mm.

These embodiments are intended to be within the scope of the invention(s) herein disclosed, but not intended to provide an exhaustive list of all of the novel embodiments, aspects and features disclosed therein. These and other embodiments disclosed herein will become readily apparent to those skilled in the art from the following detailed description of the preferred embodiments having relevance to the attached figures, the invention(s) not being limited to any particular preferred embodiment disclosed.

BRIEF DESCRIPTION OF THE DRAWINGS

The disclosed technology is illustrated by way of example and not limited by the figures of the accompanying drawings, in which like references indicate similar elements. The figures are not necessarily to scale or intended to illustrate the correct size proportions between components.

DETAILED DESCRIPTION

Various embodiments and aspects of the disclosed technology will be described with reference to details discussed below, and the accompanying drawings will illustrate various embodiments. The following description and drawings are illustrative of the technology and are not to be construed as limiting the disclosure in any way. Numerous specific details are described to provide a thorough conceptual understanding of various embodiments of the disclosed technology. However, in certain instances, well-known or conventional details are not described in order to provide a concise discussion of various embodiments.

Figure 1:
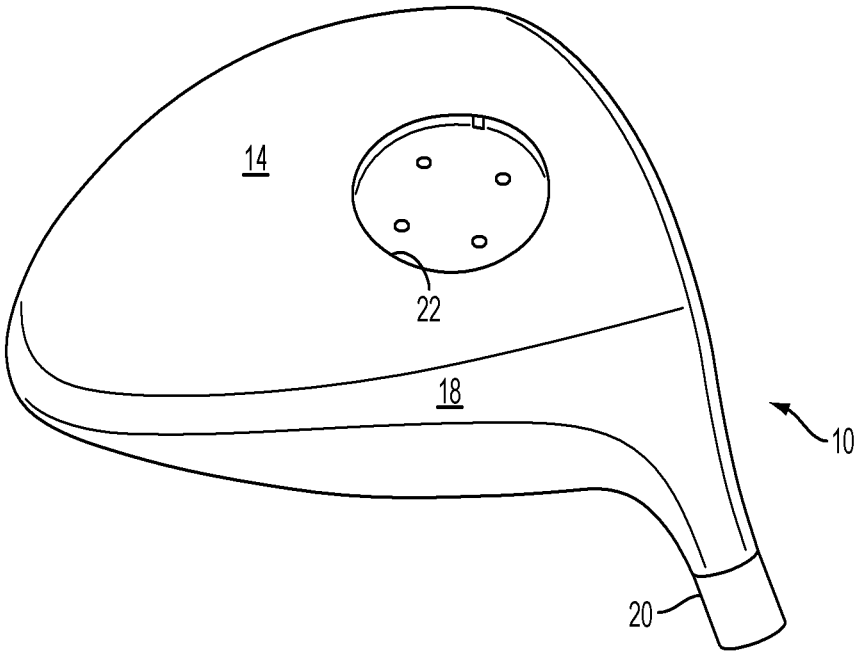
FIG. 1 is an illustration of an embodiment of a golf club head according to the present disclosure.
Figure 2:
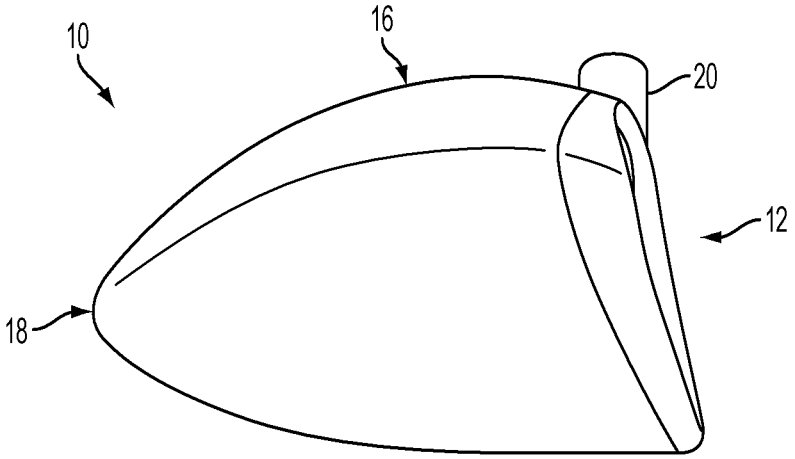
FIG. 2 is an elevation view from a toe side of the head of FIG. 1, with a face plate omitted for illustrative purposes.
Figure 5:
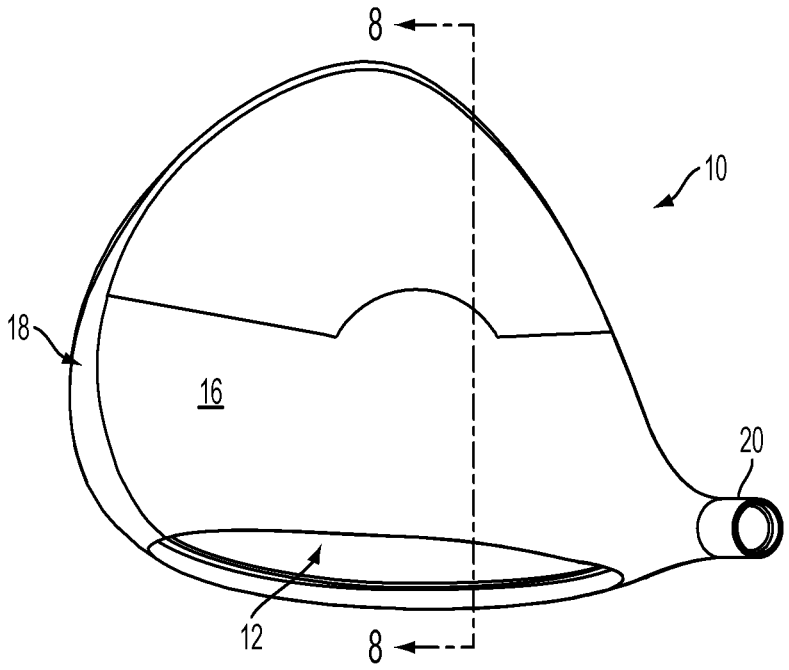
FIG. 5 is a top plan view of the head of FIG. 1, with the face plate removed as in FIG. 4.

With reference to FIGS. 1, 2 and 5, a metal wood-type golf club is shown having a body 10 and a front opening 12 to receive a face plate (i.e., face insert) used to strike a golf ball. The body 10 includes a sole 14, a crown 16 (i.e., top), and a skirt 18 therebetween. The head also has a hosel 20 located on a heel side of the head to receive a shaft (not shown) which is attached thereto. A toe portion of the head is opposite the heel portion.

The club head body 10, which is largely hollow, typically defines a volume of about 130 cubic centimeters (cc or $cm^3$) to about the current USGA limit of 460 cc. In some embodiments described herein, the club head volume is from about 360 cc to about 460 cc, such as from about 425 cc to about 460 cc. In other embodiments, the club head volume may be greater than 460 cc. The body may have attached or incorporated therein weight ports, ribs, performance adjustment components and other features, such as a recess 22 for receiving a weight plug. The body 10 preferably has a thin-wall construction formed by casting or otherwise from suitable metal or non-metal materials, such as squeeze-cast magnesium alloys, steel, combination of magnesium and titanium alloys, and preferably cast titanium alloys known for their high strength and light weight properties. A multi-piece body made from one or more different materials may be used with, for example, the sole, skirt and part of the crown formed by known metal casting methods and the remaining crown portion formed from stamped metal or composite material. In some embodiments, including the one described herein, the head body 10 is a single integrated piece formed from a cast titanium alloy.

The club head body may be formed by investment casting a titanium alloy such as Ti-6A1-4V. Alternatively, a soluble wax may be used to create the club head body.

Figure 3:
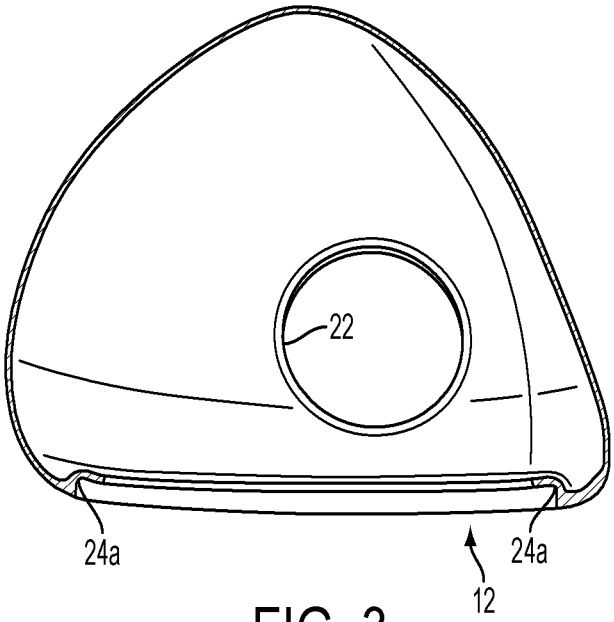
FIG. 3 is a horizontal cross section view of the head taken along line 3-3 of FIG. 4.
Figure 4:
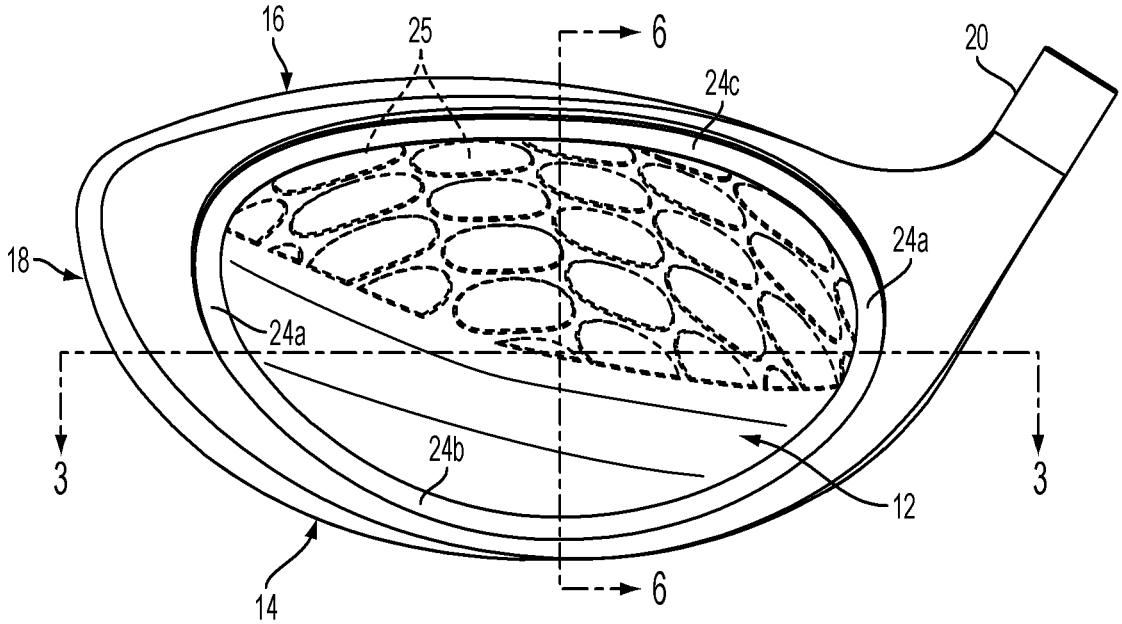
FIG. 4 is a front elevation view of the head of FIG. 1, with the face plate removed and internal features shown in dashed lines.
Figure 6:
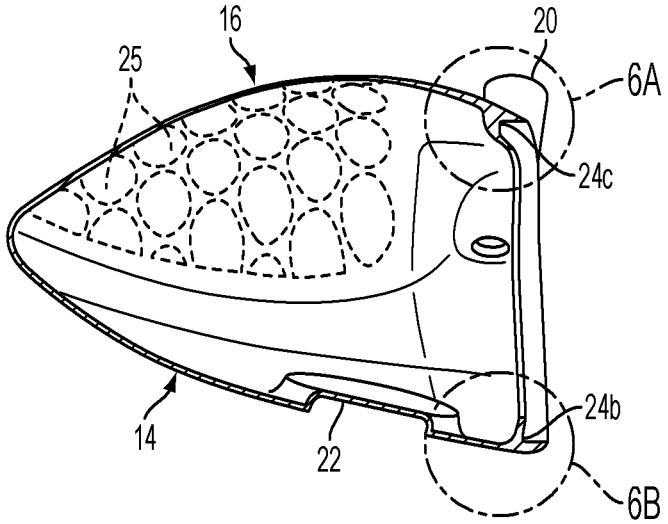
FIG. 6 is a cross section view taken along line 6-6 of FIG. 4, again with the face plate omitted.
Figure 6A:
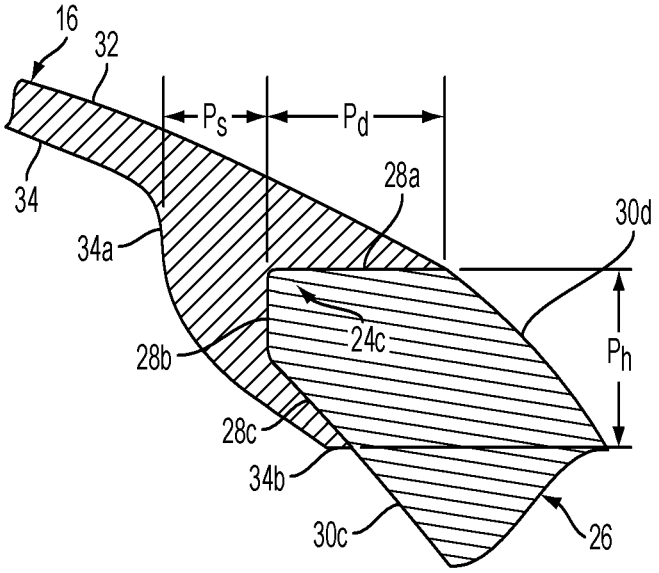
FIG. 6A is a detailed view of section 6A of FIG. 6, depicting a face plate support feature in the crown area of the club head.
Figure 6B:
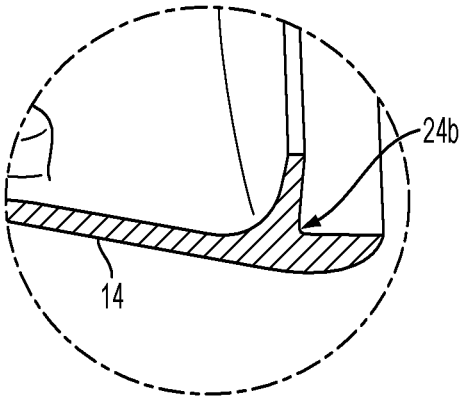
FIG. 6B is a detailed view of section 6B of FIG. 6, depicting a face plate support feature in the sole area of the club head.
Figure 6C:
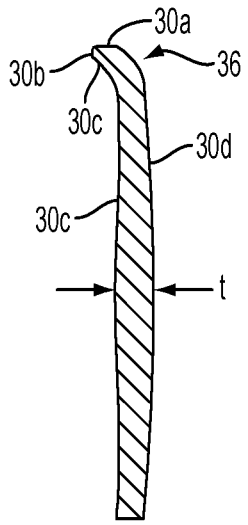
FIG. 6C is a vertical midsection view of the face plate.
Figure 8:
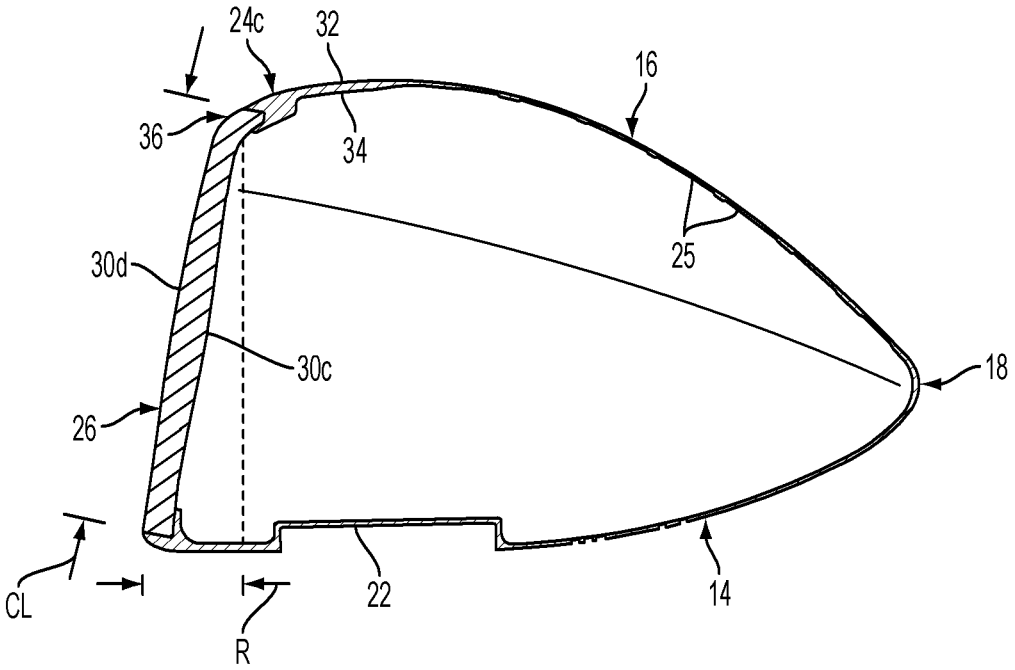
FIG. 8 is a section view taken along line 8-8 of FIG. 5, with internal features of the club head omitted and the face plate added.

FIGS. 3, 4 and 5 illustrate the front opening 12 which receives a composite face plate or insert (as shown in FIGS. 6A, 6C and 8). FIG. 3 is a horizontal cross section view the head body 10. FIG. 3 illustrates a known construction for supporting the toe and heel sides of the face insert in which the club body includes opposed support frames 24*a* which define a recess or pocket to receive the face plate. Each support frame 24*a* has walls that join at a substantially right angle corner to provide a supporting lip for the toe and heel sides of the face plate. The depth of the recess corresponds closely to the thickness of the face plate such that the face plate is flush with the front surface of the head body 10 when it is received within the opening 12. The weight port 22 is shown as generally circular in FIG. 3, but it will be appreciated that other weight port geometries are feasible for adding weight to the sole area of the club head.

In one embodiment, the weight port 22 may be sized to receive a round shape-compatible weight (not shown) having a diameter of about 25 to 35 mm (preferably about 30 mm), and a height or depth of about 3 to 4.5 mm (preferably about 3.75 mm).

FIGS. 4 and 5 illustrate that the body 10 forms a face plate-supporting frame or lip, including support frame 24*a*, that preferably extends continuously around the opening 12 to support the face plate on all sides. The opening 12 and support frame that bounds the periphery of the opening are curvilinear and may have various configurations typical of golf club heads, including the substantially elliptical shape shown. The opening and frame for example may have a substantially semi-circular or substantially cup-like shape.

FIG. 4 further illustrates that inside surface portions of the crown and skirt have thin wall pockets or zones 25. The zones 25 have a wall thickness that is less than the wall thickness of the lattice or web of thicker crown and skirt portions therebetween. The zones 25 create additional mass savings that can be redistributed elsewhere, as for example in a weight plug located in the weight port 22, a location that contributes to lowering the CG of the club head.

It will be appreciated that the thin wall zones or pockets 25 may have a wall thickness of about 0.4 mm, as compared to a wall thickness of about 0.6 mm for the wall-reinforcing, web-like wall portions therebetween. The zones 25 may have a variety of individual shapes and be arranged in group patterns other than the elliptical shape and pattern shown in FIG. 4. The zones preferably have at least a partially curvilinear shape and some zones may have a fully closed curvilinear shape. The term "elliptical shape" includes the cut-off elliptical shapes shown in FIG. 4.

FIG. 6 is a vertical cross section taken along line 6-6 of FIG. 4 through a mid-section of the club head body 10, and illustrates the shape of the face plate support frame along the sole and crown edges of the head body 10. The thin wall zones 25 are shown on the inner wall surfaces of the crown and skirt.

FIG. 6B is an enlarged detailed view of section 6B of FIG. 6 and shows that the face plate support structure has a support frame 24*b* in the sole area with a profile similar to the support frames 24*a* located at the toe and heel ends of the face plate. Like the opposing support frames 24*a* in the toe and heel areas, the support frame 24*b* has two walls forming a substantially right angle corner to receive and support a lower sole edge of the face plate. With the club head resting on the ground in a normal address position, the sole support frame 24*b* has one wall that is generally vertical and a second wall that is generally horizontal relative to the ground.

As used herein, "normal address position" means the club head position wherein a vector normal to the center of the club face lies in a first vertical plane (a vertical plane perpendicular to the ground plane), a centerline axis of the club shaft (or hosel) lies in a second vertical plane, and the first vertical plane and second vertical plane perpendicularly intersect.

FIG. 6A is an enlarged detailed view of section 6A of FIG. 6, and shows a support frame 24*c* in the crown area that contrasts with support frames 24*a*, 24*b*. Unlike support frames 24*a*, 24*b*, the support frame 24*c* defines a pocket, recess or channel having at least three separate substantially flat walls to support a face plate 26 on three sides. More specifically, the recess defined by the support frame 24*c* includes a sole facing wall 28*a* that supports and engages a top surface or edge 30*a* (FIG. 6C) of the face plate 26, a forward facing wall 28*b* that supports and engages a rear facing edge 30*b* (FIG. 6C) of the face plate, and an upwardly inclined wall 28*c* that supports and engages an inner wall 30*c* of the face plate. The face plate also includes an outer wall 30*d* opposite inner wall 30*c*. The face plate walls 30*c*, 30*d* are curvilinear and generally parallel to one another to give the face plate a general thickness "t" (FIG. 6C). In one exemplary embodiment, the thickness t is generally about 3.5 mm to 6 mm (5.25 mm in one example), although the thickness in most embodiments varies a modest amount relative to "t" across the face plate and, for example, may be thicker in a central area of the face plate. In one preferred embodiment, the thickness t is the greatest in a central sweet spot area of the face plate and gradually lessens in a direction moving outwardly therefrom. For example, the central thickness may be about 5.75 mm and the edge thickness may be about 3.75 mm.

In one example, the edge 30*a* (FIG. 6C) of the face plate may have a length of about 2 mm to about 4 mm, the edge 30*b* (FIG. 6C) may have a length of about 0 mm to about 1.5 mm, and the portion of the wall 30*c* contacting the support frame may have a length of about 2.74 mm.

As can be seen in FIG. 6A, the support frame 24*c* supportively engages the face plate on three sides, thereby providing a secure connection between the head body and face plate in the crown interface area when the face plate is subject to high impact loading caused by ball impact. This secure connection facilitates a face plate design in which the upper edge of the face plate has a significantly greater curvature than the roll curvature typical of conventional face plates and allows the upper edge to extend and "wrap around" what would otherwise be part of the crown 16 of the head body. In this way, the extended face plate shrinks the crown area formed by the metal club head body, thereby replacing some of the mass of the metal head body with the mass of the lighter composite face plate to provide the club designer with discretionary mass that can be located elsewhere in the head body 10.

The composite face plate 26 may be attached to the metallic club head body 10 using adhesives or other conventional techniques. In order to prevent peel and delamination failure at the face body junction, the composite face plate should be slightly recessed from or substantially flush with the plane of the forward surface of the metal body at the junction.

Referring to FIGS. 6A and 6C, the outer wall 30*d* of the face plate generally has a roll curvature of about 10 to 14 inches, preferably about 12 inches, in the midsection where the face plate typically strikes the golf ball and for much of its length. In contrast, the curvature of the face plate's outer wall 30*d* increases sharply near its upper crown end as the face plate approaches and contacts the frame support 24*c* to provide a smooth transition between the face plate and crown of the head body 12. In a typical metal wood, there must be a relatively sharp transition at this juncture as the club face (i.e., impact surface) makes a roughly 90 degree turn to form the crown of the club head. In a preferred embodiment, the face plate's impact wall 30*d* transitions from the typical "roll" radius of about 10 to 14 inches for much of its length to a radius of curvature of about 3.7 mm to about 77.0 mm, at its upper crown end as the face plate approaches and is engaged by the crown support frame 24*c*. The tighter radius of curvature in this area of the face plate may be considered a crown transition radius since the face plate at least partially if not fully completes the transition from the club face to the crown. The "crown" transition radius area is designated by the reference 36 in FIG. 6C.

Figure 6D:
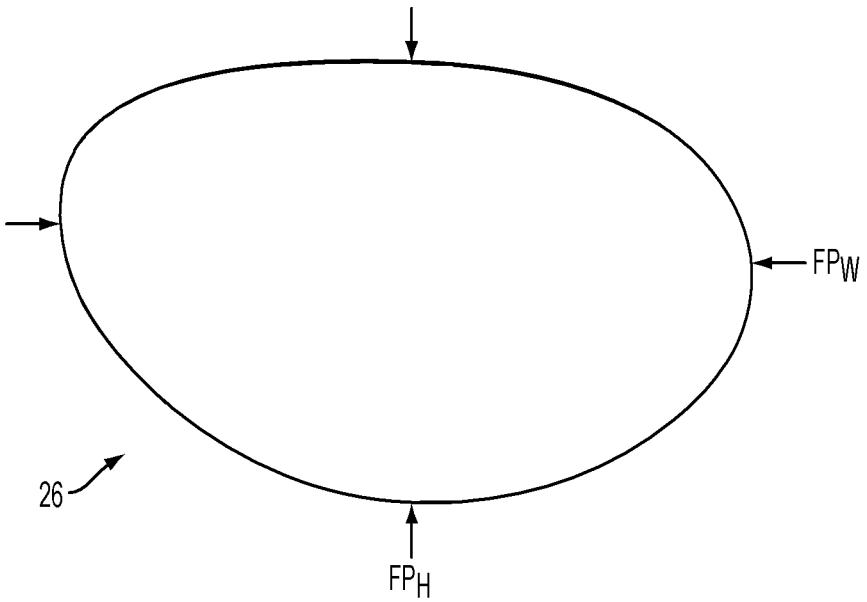
FIG. 6D is a front elevation view of the face plate.

In FIG. 6D, the face plate 26 is shown having a maximum face plate height $FP_H$ between a crown edge/end a sole edge/end, and maximum face plate width of $FP_W$ between opposed skirt edges/ends. The $FP_W$ and $FP_H$ dimensions may vary depending on a number of factors, including whether the wood is a driver, 3-wood, other wood or hybrid. In one exemplary embodiment for a driver, the face plate has a $FP_H$ of about 57 to 67 mm, preferably about 62 mm, and an $FP_W$ of about 90 to 106 mm, preferably about 98 mm. The face plate's outer wall may have a surface area of 4200 to 5000 $mm^2$ and preferably a surface area of about 4400 $mm^2$.

The face plate 26 forms part of the head's club face which also includes a portion of the head body near the hosel.

The disclosed technology is well-suited for use with a composite face plate 26. The face plate may be formed from plies (layers) of composite material (prepeg) and can be defined according to the combination of fiber, resin system, fiber area weight (FAW) and resin content (R/C) use. One example of a preferred prepeg is 70 g FAW 34/700 material which comprises 34/700 fiber, Newport 301 resin, 70 $g/m^2$ FAW and 40% R/C. Various embodiments of suitable composite face plates, and methods of manufacture, are disclosed in U.S. Pat. No. 7,267,620, titled GOLF CLUB HEAD AND METHOD OF MANUFACTURE, which is incorporated herein by reference. Reissue Patent No. RE42, 544, titled GOLF CLUB HEAD, also is herein incorporated by reference.

The composite face plate 26 can be manufactured by stacking and cutting the plies in predetermined orientations. This may be done in smaller groups of plies that are eventually stacked to form a final thickness of the face plate. More particularly, the plies of prepeg can be arranged in specific groups in which each ply has a predetermined orientation with reference to a horizontal axis. For example, a first or outermost ply may comprise 1080 glass fabric oriented at 0 degrees, followed by 48 plies of 34/700 prepeg oriented sets of 12 plies or at 0, +45, 90 and −45 degrees. Another ply of 34/700 at 90 degrees proceeds the final or innermost ply of 1080 glass fabric oriented at 0 degrees.

The face plate preferably achieves the final desired shape or dimensions by die cutting. The final desired bulge and roll of the face plate may be achieved during the last two or more "debulking" or compaction steps to reduce air trapped between plies. Preferably a third debulking step includes forming a panel having the final desired bulge and roll and more preferably an additional fourth debulking step is provided to form the panel to a final face thickness.

While the embodiments described herein are ideally suited for heads having a composite face plate, the face plate may be made from a metal alloy (e.g., an alloy of titanium, steel, aluminum and/or magnesium), ceramic material, or a combination of composite, metal alloy, and/or ceramic materials.

Referring to FIG. 6A and FIG. 8, the support frame 24*c* for supporting the crown edge of the face plate is formed by an enlarged extension of the crown wall 16, which includes an outer crown wall surface 32 and inner crown wall surface 34. As inner crown wall surface 34 approaches the support frame 24*c*, it diverges from outer wall surface 32 to form the enlarged crown support frame 24*c* in which the face plate receiving recess or pocket is formed. Significantly, the inner wall surface 34 diverges gradually at turn 34*a* (FIG. 6A) in a manner that does not create a reverse angle (i.e., reverse change of direction) and then terminates at a lip 34*b*. This design improves the manufacturing process and avoids complications associated with prior face plate support designs having a reverse angle construction. The inner and outer wall surfaces 32, 34 diverge or enlarge the wall a sufficient amount to allow the pocket or channel to be formed therebetween. The support frame 24*c* and channel formed therein extends across the crown edge of the club head body 10, as FIG. 4 illustrates.

In one embodiment, the support frame 24*c* for supporting the crown edge of the face plate preferably has a pocket height $P_h$ of about 3.5 mm to 4.5 mm, a pocket depth $P_d$ of about 3.5 mm to 4.5 mm and a pocket set back $P_S$ of about 2.0 mm to 3.0 mm, as illustrated in FIG. 6A.

FIG. 8 is a vertical cross section taken along line 8-8 of FIG. 5, and illustrates the mildly arcuate roll radius of the face plate 26 at its midsection and along much of its length, as well as the transition radius area 36 where the radius of curvature is sharper as the face plate becomes proximate to and contacts the support frame 24*c* of the crown. The face plate preferably has a curvilinear length (or arc length) CL of at least 55 mm, preferably about 62 mm. Given the wrap around geometry of the face plate at the crown interface, the leading edge of the crown 16 is set back or recessed from the leading edge of the sole 14 a distance R. In one exemplary embodiment, the set back R is about 10 to 25 mm, preferably about 17 mm to 19 mm, when the head is in a normal address position.

FIG. 8 further illustrates that in a preferred embodiment the crown and sole have thicker walls in a high stress area closer to the face of the club head. For example, the crown wall proximate to the club face preferably has a wall thickness of about 0.8 mm, and the sole wall proximate to the club face preferably has a wall thickness of 1.1 mm. Moving away from the high stress impact area the thin wall zones 25 and web of thicker walls therebetween can be seen in the crown portion set back from the club face. In addition, the weight port or recess 22 is shown to be located much closer to the club face than rear end of the club head.

Figure 7:
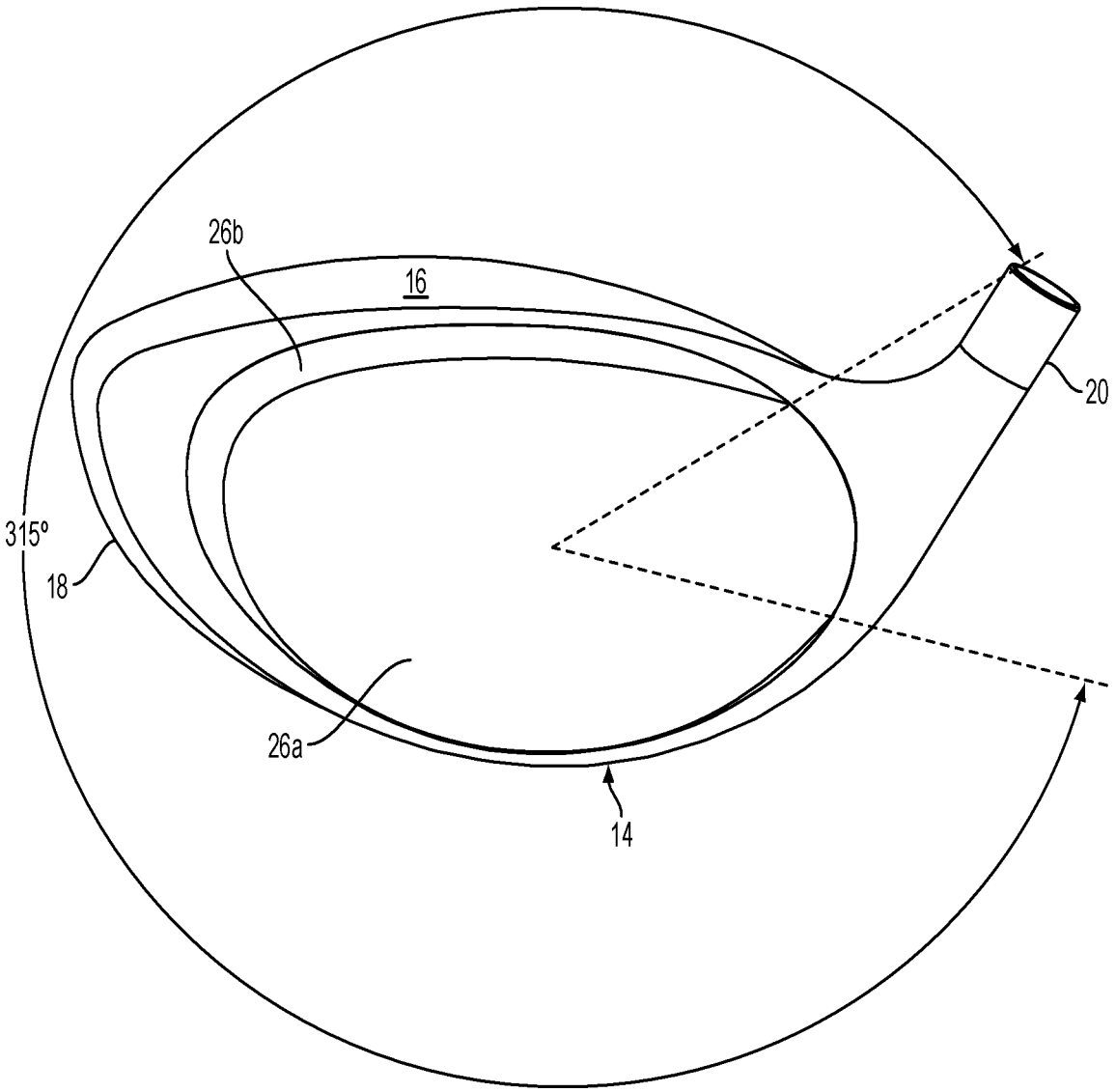
FIG. 7 is a schematic front elevation view of the golf club head of FIG. 1.

With reference to FIG. 7, the face plate 26 includes a bulge/roll section 26*a* and a face wrap zone 26*b*. Section 26*a* represents an area typical of conventional face plates, with the curvilinear outer wall or striking surface having a typical bulge radius from toe to heel and a typical roll radius from sole to crown. The face wrap zone 26*b* represents an extended zone in which the face plate has a much sharper transition radius of curvature and wraps partially or completely around one or more transition areas, including face to crown, face to sole and/or face to skirt. While the embodiment described above in FIGS. 1-6 and 8 provides a face wrap zone only along the crown-face plate interface, FIG. 7 illustrates that the face wrap zone can be extended to include the toe region as well, where the face plate transitions to the skirt portion of the club head on the toe side. In yet another embodiment, since the frame support provided by the club head body has a frame or lip that supports the face plate along substantially its entire periphery, the face plate can be extended to provide "wrap around" zones in every direction. The transition radii of curvature in these zones can vary from about 4 to 101 mm (preferably about 51 to 101 mm or about 2 to 4 inches at the crown interface, about 14 mm to 77 mm at the toe interface and about 1.3 mm to 21 mm at the sole interface to provide a smooth continuous transition zone along one or more peripheral areas of the face plate. Due to offsetting considerations in the area of the hosel 20, yet another embodiment can provide a face plate with a wrap around zone extending along a 315 degree arc of the face plate's periphery (see arc in FIG. 7), excluding only a periphery area adjacent the hosel.

Figure 9:
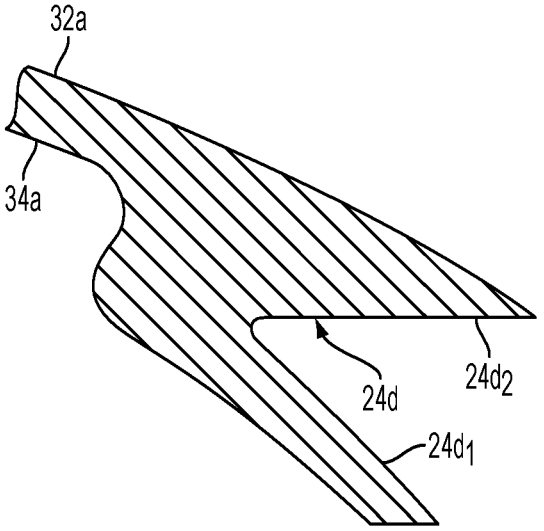
FIG. 9 is a detailed view similar to FIG. 6A but showing a second embodiment of the face plate support in the crown area.

FIG. 9 is a cross section view of an alternative embodiment of the support frame which supports the crown end of the face plate. In this embodiment, the enlarged crown wall provides a frame support 24*d* having a face plate supporting recess or pocket defined by only two walls. Also, while the enlarged end portion of the crown is formed at the terminal or distal ends of diverging inner and outer walls 32, 34, the inner wall takes two sharper turns of about 90 degrees before terminating at the mouth of the recess.

FIGS. 10-15 show an alternative embodiment of the club head, including a club head body 110, front opening 112, sole 114, crown 116, skirt 118 and hosel 120. The hosel 120 has a hosel bore with a hosel axis.

Figure 10:
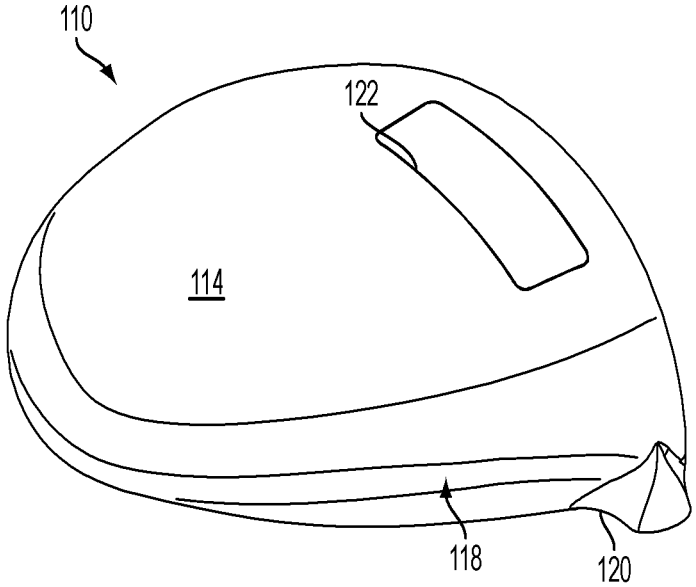
FIG. 10 is a perspective view of an alternative embodiment of the club head.

Referring to FIG. 10, the club head body includes an elongated weight recess or pocket 122 formed in the sole 114 of the body. The pocket 122 can have various shapes and sizes other than the substantially rectangular shape shown but preferably is located proximate to the face of the club head and slightly off-center in favor of the heel side of the head.

Figure 11:
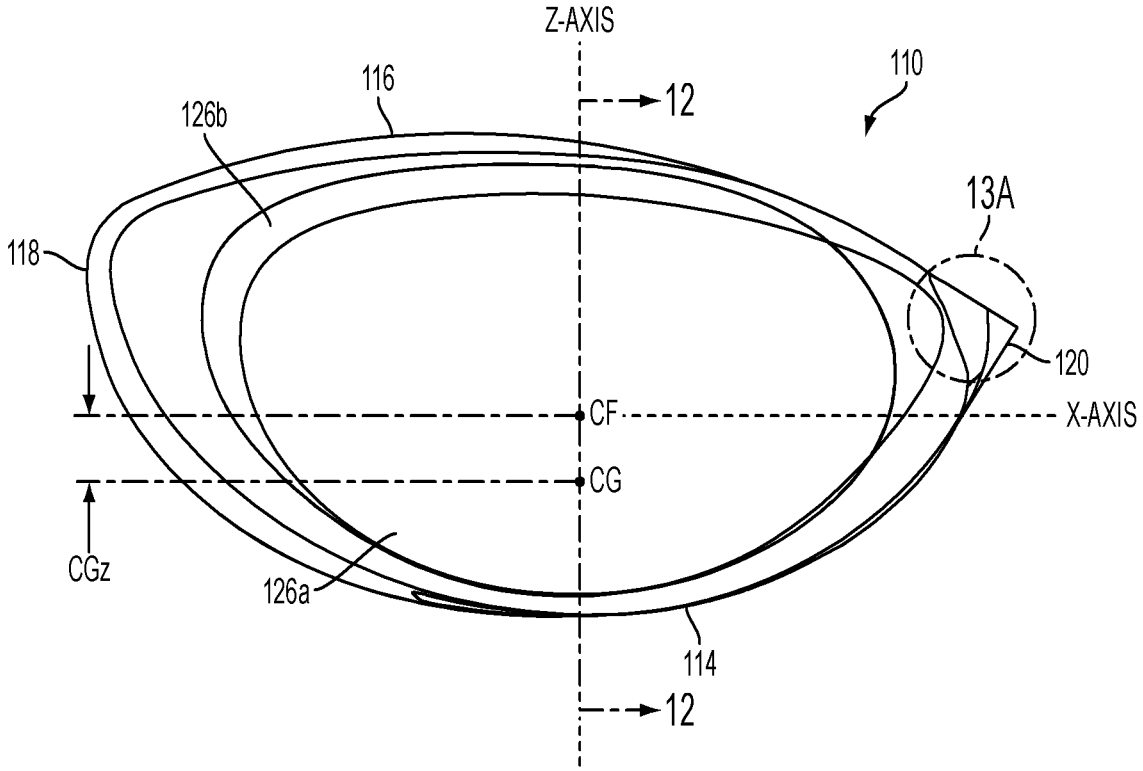
FIG. 11 is a front elevation view of the club head of FIG. 10.

FIG. 11 shows a front elevation view of the head body 110, which differs from body 10 in a number of respects, including a shorter hosel 120 that is substantially flush with the crown. The face of the club head has a face plate which includes a central area 126*a* having bulge and roll radii typical of conventional face plates and an extended wrap around zone 126*b* with a much sharper radius of curvature as described above. The wrap around zone 126*b* shown in FIG. 11 extends along the crown juncture and along the juncture between the toe side of the face plate and skirt. The mass savings created by extending the lighter composite face plate into what otherwise would be metal crown and skirt portions of the head body and by other features described herein can be redistributed in a low forward location of the club head to significantly relocate the CG of the club head. The "CG" may be defined as the point at which the entire weight of the golf head may be considered as concentrated so that if supported at this point the head would remain in equilibrium in any position.

Definition

FIG. 11 also illustrates a coordinate system frame of reference as described in U.S. patent application Ser. No. 13/730,039, filed Dec. 28, 2012, which is incorporated herein by reference. As described therein, the location of the CG of the golf club head can be identified by the distance along three coordinate axes from a head origin coordinate system. The head origin coordinate system is a rectangular (x,y,z) system which has its origin located at the center of the striking face when the head is in the normal address position. The z-axis extends through the head origin in a generally vertical direction relative to the ground. The x-axis extends through the head origin in a toe-to-heel direction generally parallel to the striking surface (generally tangential to the striking surface at the center) and generally perpendicular to the z-axis. The y-axis extends through the head origin in a front-to-back direction and is generally perpendicular to the x-axis and the z-axis. The x-axis extends in a positive direction from the origin towards the heel of the club head. The y-axis extends in a positive direction from the head origin towards the rear portion of the club head. The z-axis extends in a positive direction from the origin towards the crown. The CG in the head origin coordinate system can be defined by the three components of the distance from each axis as CGx, CGy, and CGz.

A center face CF is defined as the intersection of the midpoints of face height and face width of the striking surface. Both face height and face width are determined using the striking face curve which is bounded on its periphery by all points where the face transitions from a substantially uniform bulge and roll radii. The face height is the distance from the periphery proximate to the sole portion of the striking face to the periphery proximate the crown portion measured in a vertical plane normal to the x-axis that runs through the origin. The face width is the distance from the periphery proximate the heel portion of the striking face to the periphery proximate the toe portion measured in a horizontal plane normal to the z-axis that runs through the origin. For purposes of this description, the center face is also referred to as the "geometric center" of the golf club striking surface. See also U.S.G.A. "Procedure for Measuring the Flexibility of a Golf Clubhead," Revision 2.0 for the methodology to measure the geometric center of the striking face.

In the example shown in FIG. 11, the CG of the club head is located a distance CGz below a horizontal plane (i.e., a plane that is parallel to a ground plane) that intersects the center face location CF. In some embodiments, the CGz is less than about −6 mm, such as less than about −8 mm, such as less than about −10 mm.

Figure 12:
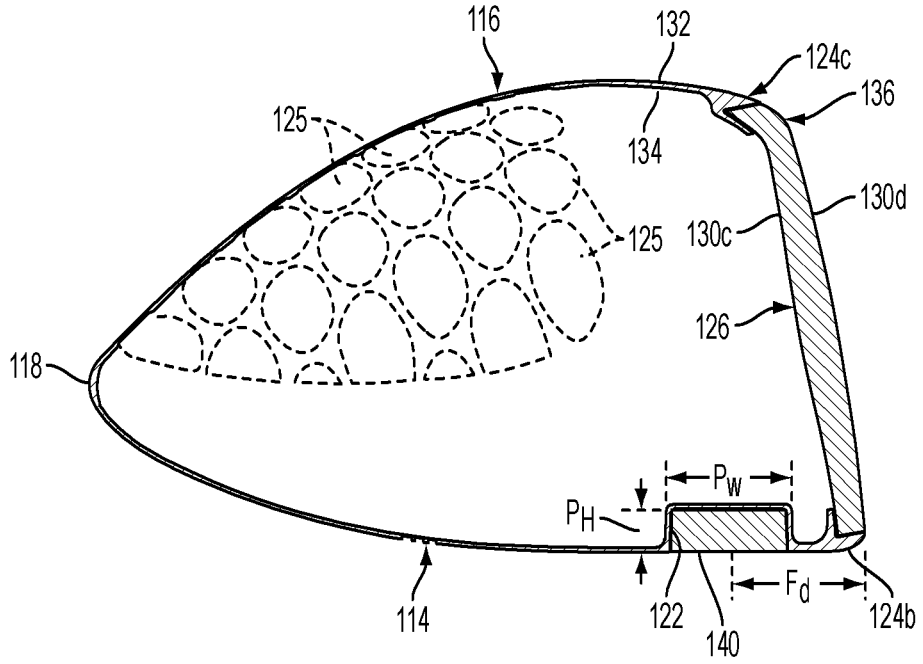
FIG. 12 is a vertical cross section taken along line 12-12 of FIG. 11.

FIG. 12 is a cross section view along line 12-12 of FIG. 11. As described above, the club head body is a thin-wall construction including the sole 114, crown 116 and skirt 118. The body also includes thin-wall zones 125 formed preferably in crown and skirt portions of the club head while maintaining smooth outer crown and skirt surfaces. The club head walls are thicker as they approach the crown and sole support frame 124*b*, 124*c* to provide additional structural support in high stress areas near the club's ball striking surface. The increased wall thickness is preferably about 0.8 mm in the crown area and about 1.1 mm in the sole area, as compared to a preferred thickness of 0.6 mm in other areas of the head body and about 0.4 mm in the thin wall zones 125.

The support frames 124*a*, 124*b*, 124*c* support a face plate 126 as previously described. In the FIG. 12 embodiment, the enlarged crown support frame 124*c* has a V-like recess or channel which supportively engages the face plate 126 on only two sides but, as before, the channel is formed without requiring the inner wall surface 134 to undergo a reverse angle change of direction. The face plate is shown having a wrap around zone in the crown area, but wrap around zones may be provided in one or more of the crown, sole and skirt areas, to provide additional discretionary mass to be reallocated to a low, forward location of the club.

FIG. 12 also illustrates that while the overall thickness of the face plate does not deviate substantially, certain local areas may have increased thickness as, for example, the center sweet spot area of the face plate, as described above. Additional details concerning the variable face plate thickness and manufacturing methods for the face plate are provided in U.S. Pat. No. 7,874,936, which is incorporated by reference herein.

FIG. 12 further illustrates that the weight port 122 receives a weight plug 140 and is located in the lowest portion of the club head body and proximate to the club face, where the golf ball is struck. In one example, the weight port may have a height $P_H$ of about 1 mm to 6 mm (preferably about 5.8 mm), width $P_W$ of about 14 mm to 18 mm (preferably about 16 mm), length of about 40 mm to 60 mm (preferably about 47 mm), and a geometric center located a distance $F_d$ of about 14 mm to 20 mm (preferably about 18.5 mm) from the leading edge of the club face. The geometric center of the plug 140, when projected on the center face, may be laterally offset on the x-axis a distance of about 9 mm toward the heel. In other words, the CG of the weight plug is slightly closer to the heel than the toe of the club head, relative to the head's CF.

In one embodiment, the plug 140 is made from a tungsten alloy, has a generally rectangular shape and has a mass of about 50 to 75 g. Alternative shapes, profiles and mass may be used as well (see FIG. 1 for example).

The weight plug 140 (as well as the round weight plug compatible with weight port 22) may be affixed to the club head by glue or other adhesives, brazing, welding, screw fasteners, co-casting or integrally casting, or other commonly known joining techniques.

Figure 13:
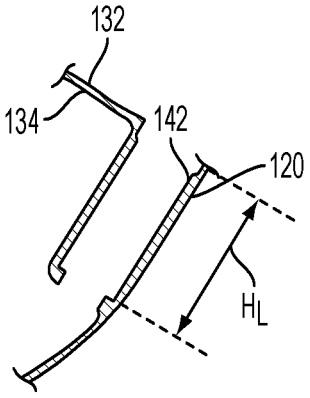
FIG. 13 is an enlarged detailed sectional view of section 11A of FIG. 11.

Referring to FIG. 13, the club head body 110 includes a shortened hosel 120 that is substantially flush with the crown surface and has a bore 142 for receiving a club shaft in a conventional manner. In one preferred example, the hosel has a bore length $H_L$ of about 20 mm to 24 mm. The reduced size of the hosel and shortened bore creates additional mass savings that can be reallocated strategically elsewhere on the club, such as in the weight plug 140.

Figure 14:
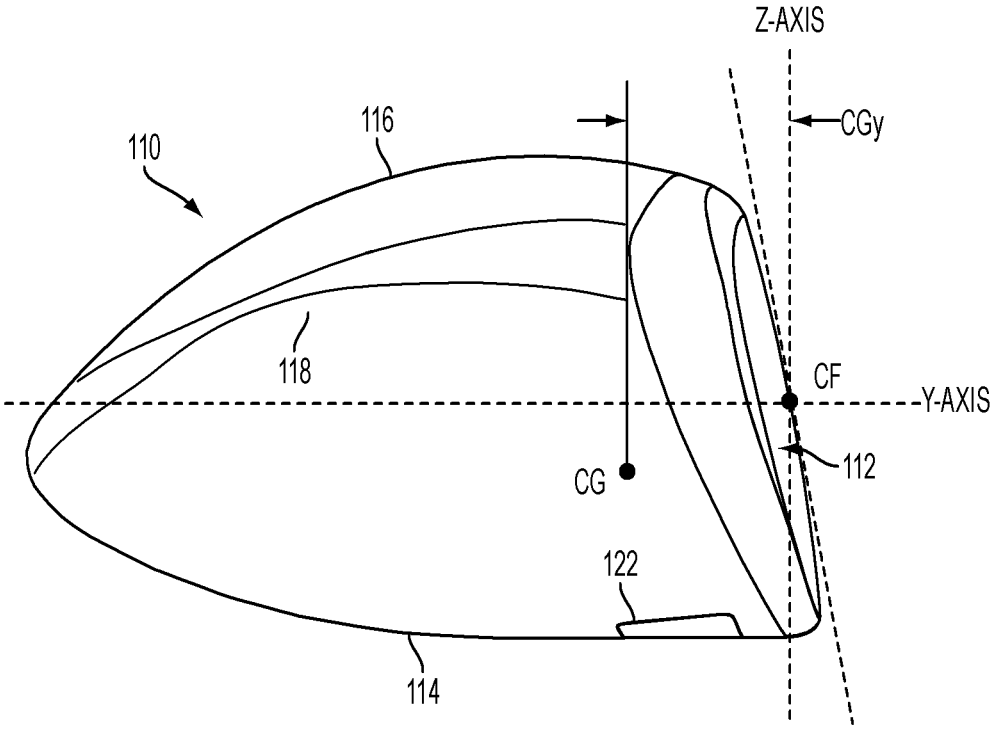
FIG. 14 is a side elevation view of the club head of FIG. 10 from the toe side of the head.

In the embodiment shown in FIG. 14, the CG of the club head has a CGy value that represents the distance the CG is located rearward of a vertical plane (i.e., a plane that is perpendicular to a ground plane) that is tangent to the face at the CF location. In some embodiments, the CGy of the club head is less than about 29 mm, such as less than about 26 mm, such as less than about 24 mm.

This CG location relatively close to the face, and relatively close to an optimum center face ball impact location on the face, results in the club head delivering higher energy transfer to the ball and imparting higher ball speed off the club face. This translates to the ball travelling a greater distance. Additionally, with the CG located lower (closer to the sole), as FIG. 11 illustrates, the resulting backspin of the ball is reduced. Reduced backspin is highly desirable in a driver-type club. In the context of a driver, these advantages may be accomplished while maintaining a large volume of at least 360 to 460 cc, preferably at least about 425 cc and most preferably at least about 460 cc, large face size (about 4400 to 5000 $mm^2$) and aerodynamic shape. In this example, the club head, including face plate, may have a mass of about 180 to 210 grams including a weight plug mass of about 50 to 74 grams. The 50 to 74 grams is attributable at least partially to redistributed mass savings from the wrap around face plate, thin wall zones and reduced hosel. This contrasts with typical driver heads which undesirably produce more backspin due to gear effect, and deliver less energy to the ball due to a higher CG located farther away from the face. It will be appreciated that adjustments can be made to accommodate a volume greater than 460 cc and plug mass greater or less than 50 to 74 grams. The term "volume" (typically measured in $cm^3$) as used herein is equal to the volumetric displacement of the club head, assuming any apertures are sealed by a planar surface, using the method prescribed by the United States Golf Association and the R&R Rules Limited.

Figure 15:
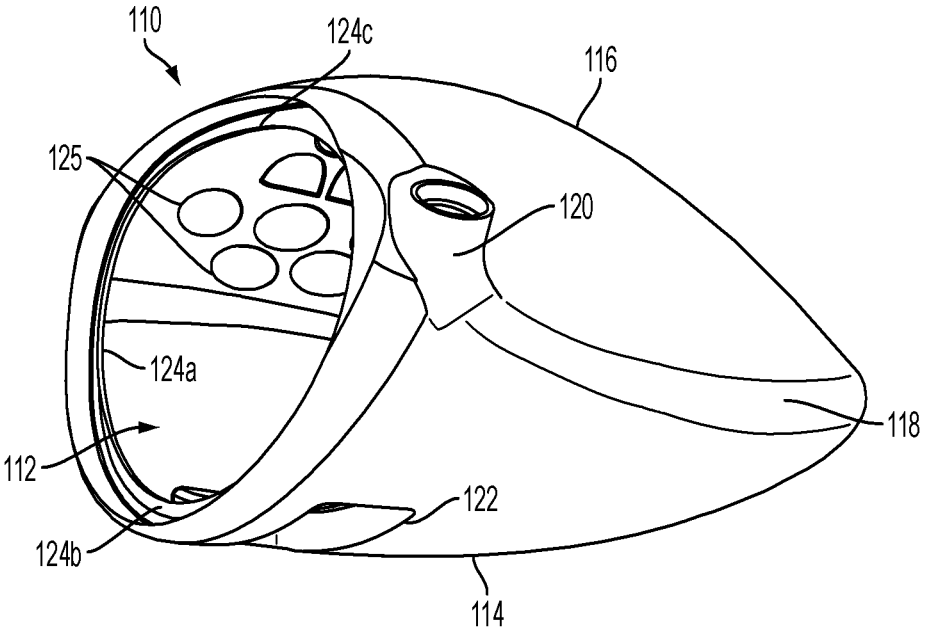
FIG. 15 is a perspective view of the front of the club head of FIG. 10, with the face plate removed.

FIG. 15 provides a better illustration of the substantially flush hosel 120, heel side of the weight port, and thin wall pockets or zones 125 located on the inside surface of the crown and skirt.

Expanding the foregoing explanation, current club designers apply conventional wisdom to pursue a higher moment of inertia in order to achieve more forgiveness on off center hits. Higher moment of inertia gives greater resistance to rotation on off center hits which results in less ball speed loss. For drivers, the ball also starts off line with sidespin due to heel-toe off center hits. The face bulge radius (radius from heel-to-toe) is typically designed to counteract the deviation angle and sidespin due to off center hits, and helps the ball curve back to the center. Thus, with a properly designed bulge radius, the benefit of higher moment of inertia is more to reduce ball speed loss than to increase directional accuracy on off center hits. The off center ball speed loss is not as severe for most modern clubs because they utilize variable thickness face designs which are thicker near the center region and thinner towards the edge.

However, one disadvantage of higher moment of inertia clubs is that the CG typically moves back and higher since the mass needs to be moved to the periphery in order to maximize this property. The disadvantage of moving the mass back and higher is that the spin increases significantly which can reduce overall distance. When looking at the pros and cons of higher moments of inertia with a higher/back center of gravity versus a slightly lower moment of inertia with a lower, more forward center of gravity, it surprisingly turns out that there is a distance advantage to seeking a lower CG than known clubs, in combination with the CG being more forward, even if the moment of inertia is reduced slightly. This can be defined by the ratio of CGz/CGy. When CGz is a more negative number this means the center of gravity is more below center face. When CGy is a smaller positive number, this means the CG is less far back (front-to-back) from the center face. When the ratio of CGz/CGy becomes more negative, then this indicates that the trajectory will be hotter and deliver more distance.

It has been found that launch conditions for maximum driver distance typically occur at about a 14-16 degree launch angle and about 1800-2200 rpm spin. For most golfers, with prior driver CG's this is very difficult to attain. When driver loft is increased enough to achieve a 14-16 degree launch angle, the spin is usually much higher than 1800-2200 rpm, which means the ball will balloon and lose distance. Applicants have found that it is desirable to have a CG that is much lower and more forward than prior club heads in order for more golfers to achieve these more optimal launch conditions.

As shown in the table below, a preferred embodiment has a CGz/CGy ratio of −0.21, and an alternative embodiment has a CGz/CGy ratio of −0.41.

TABLE I

Comparison of CGz/CGy for different driver embodiments.

| Head | CGz (mm) | CGy (mm) | CGz/CGy |
|---|---|---|---|
| Head 1 | −6.0 | 28.3 | −0.21 |
| Head 2 | −10.0 | 24.3 | −0.41 |

In still further embodiments, improved performance and a desirable balance of reduced MOI with a relatively low and forward CG location is achieved by providing CGz/CGy ratios of −0.25, −0.30, −0.35, −0.40, −0.45, and −0.50, and the corresponding higher or lower moments of inertia that correspond with these ratios. Such drivers would preferably have a loft angle of less than 15 degrees, a volume between 425 cc to 470 cc, and a head height of at least 50 mm (as measured from a ground plane to the highest point on the crown when the head is in the address position). If the loft is greater than 15 degrees, the ball may launch too high, and if the volume is less than 425 cc or the head height is too shallow, the driver may be too difficult for many golfers to hit consistently.

Figure 16:
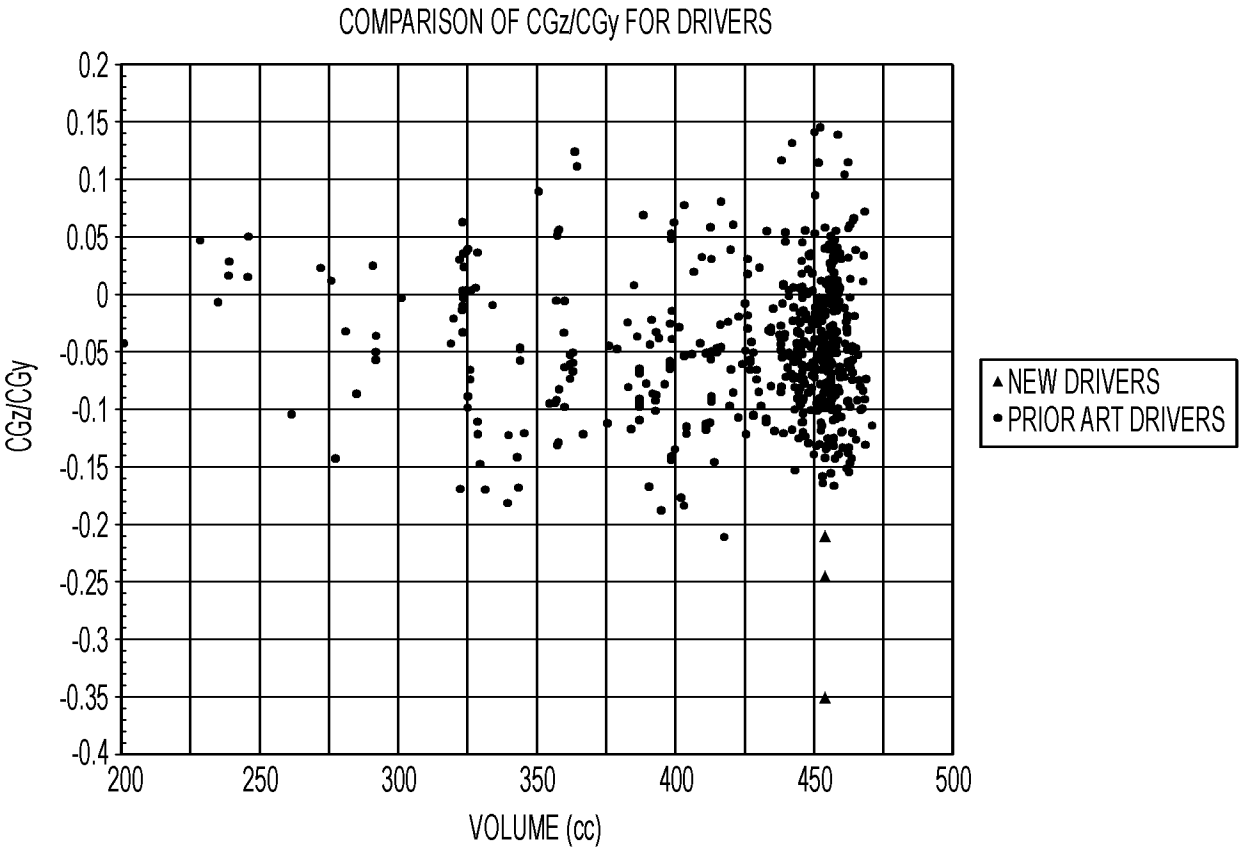
FIG. 16 is a graph comparing a CGz/CGy ratio (x-axis) and club head volume (y-axis) for driver embodiments disclosed herein with other drivers.

FIG. 16 is a graph plotting CGz/CGy driver ratios along the vertical axis against club head volume along the y-axis. Again, drivers made in accordance with the present disclosure preferably have a ratio of −0.21 to −0.41 as for example, −0.21, −0.25 and −0.35 and −0.41.

In one embodiment, a driver having a CGz/CGy ratio of at least −0.20 has a head height of at least 50 mm and/or a volume of at least 425 cc, preferably about 425 to 460 cc. In another embodiment, a driver has a CGz/CGy ratio of at least about −0.25, or at least about −0.30).

Unless otherwise indicated, the exemplary parameters mentioned herein are for a driver-type club. It will be appreciated that application of the principles herein to smaller metal-woods will necessitate some adjustment of at least some of the disclosed parameters. For example, a 3-wood necessarily will have a smaller volume and total mass than a driver, 5-wood will have a smaller volume and total mass than a 3-wood and so on.

In view of the many possible embodiments to which the principles of the disclosed invention(s) may be applied, it should be recognized that the illustrated embodiments are only preferred examples of the invention(s) and should not be taken as limiting the scope of the disclosure. Rather, the scope of the disclosure is at least as broad as the following claims. We therefore claim all that comes within the scope of these claims.

The invention claimed is:

1. A golf club head, comprising:

a club head body having an external surface with a heel portion, a toe portion, a crown portion having a forward crown area, a sole portion, and a club face;

a club head volume of at least 360 $cm^3$;

a front opening formed in the club face and comprising a recess defined by a perimeter surface of the front opening and a frame wall extending into the front opening, the frame wall comprising and outer frame wall surface and an inner frame wall surface opposite the outer frame wall surface; and a face plate received in the recess of the front opening, wherein an inner surface of the face plate is secured to the outer frame wall surface, wherein the face plate defines a ball striking surface opposite the inner surface and having a geometric center, wherein the face plate comprises a non-metallic material having a first material density, and wherein the face plate comprises a variable thickness;

wherein the crown portion comprises:

an outer crown surface and an inner crown surface, and a crown height measured relative to the outer crown surface and a ground plane when the club head is in a normal address position, wherein:

there is a first crown height at a face-to-crown transition region in the forward crown area where the club face connects to the crown portion of the club head, a second crown height at a crown-to-skirt transition region where the crown portion connects to a skirt of the golf club head near a rear end of the golf club head, and a maximum crown height rearward of the first crown height and forward of the second crown height, and the maximum crown height is greater than both the first and second crown heights, wherein, in the forward crown area and between the maximum crown height and the first crown height, the inner crown surface: diverges from the outer crown surface at a first turn, extends rearward towards the rear end of the golf club head, and merges with the inner frame wall surface at a second turn, wherein a portion of the club head body located below the geometric center of the ball striking surface is formed of a metallic material having a second material density greater than the first material density;

wherein the golf club head has a center of gravity (CG) and a head origin located at the geometric center of the ball striking surface, a z-axis extends vertically through the head origin perpendicular to the ground when the club head is in the normal address position with an upward direction being positive, a y-axis extends horizontally from the head origin in a front-rear direction when the club head is in the normal address position with a rearward direction being positive, CGz is a vertical distance of the CG of the club head from the head origin along the z-axis, and CGy is a distance of the CG from the head origin along the y-axis; and wherein the CG of the golf club head is below the geometric center of the ball striking surface as measured along the z-axis of the golf club head.

2. The golf club head of claim 1, wherein the first turn is a concave turn and the second turn is a convex turn.

3. The golf club head of claim 2, wherein the concave turn defines a concave channel in the forward crown area above the second turn.

4. The golf club head of claim 3, wherein the concave channel is an open void above the second turn.

5. The golf club head of claim 1, wherein a weight is connected to the sole portion and the weight has a third material density that is greater than the second material density.

6. The golf club head of claim 5, wherein the weight is received in a recess on the sole portion, and wherein a geometric center of the recess is located a distance of 14 mm to 20 mm from a leading edge of the club face.

7. The golf club head of claim 5, wherein the sole portion comprises a recess for receiving the weight, and the recess has a volume of at least 3.36 $cm^3$.

8. The golf club head of claim 5, wherein the weight has a center of gravity whose projection onto the ball striking surface is located off-center from the geometric center in a direction toward the heel portion and the weight is entirely external to an interior cavity of the club head body.

9. The golf club head of claim 1, wherein the face plate comprises a composite material comprising at least 48 composite plies.

10. The golf club head of claim 1, wherein the face plate comprises a composite material comprising a plurality of composite plies, wherein at least a portion of the crown portion is formed of a composite material, wherein a weight is connected to the sole portion and the weight has a third material density that is greater than the second material density, and wherein the weight has a center of gravity whose projection onto the ball striking surface is located off-center from the geometric center in a direction toward the heel portion and the weight is entirely external to an interior cavity of the club head body.

11. The golf club head of claim 1, wherein at least a portion of the crown portion is formed from composite material.

12. The golf club head of claim 1, wherein the face plate has a thickness between 3.5 mm and 6 mm.

13. The golf club head of claim 12, wherein the thickness of the face plate varies between 3.5 mm and 6 mm, and wherein a maximum thickness of the face plate is located in a central area of the face plate.

14. The golf club head of claim 1, wherein a perimeter edge of the face plate is secured to the perimeter surface of the recess.

15. The golf club head of claim 1, wherein the ball striking surface has a surface area of 5000 $mm^2$ or less.

16. The golf club head of claim 15, wherein the face plate comprises a maximum face plate height of no more than 67 mm, and wherein the face plate comprises a maximum face plate width in a range of 90 mm to 106 mm.

17. The golf club head of claim 1, wherein the frame wall has a height measured from the perimeter surface of the recess to an edge of the frame wall, and wherein the height is at least 3.5 mm.

18. The golf club head of claim 1, wherein the perimeter surface of front opening has a depth measured from the club face to the frame wall, and wherein the depth is at least 3.5 mm.

19. The golf club head of claim 1, further comprising an elongated pocket formed in the sole portion rearward of the club face.

20. The golf club head of claim 1, further comprising a face-to-sole transition region where the club face connects to the sole portion of the club head, wherein, in the face-to-sole transition region, an inner sole surface merges with the inner frame wall surface at a third turn, and wherein the third turn is a concave turn.

* * * * *